US005083372A

United States Patent [19]

Polutnik et al.

[11] Patent Number: 5,083,372

[45] Date of Patent: Jan. 28, 1992

[54] METHOD AND APPARATUS FOR ALIGNING AND CLAMPING A SERIES OF TUBES IN PARALLEL

[75] Inventors: John E. Polutnik; Lawrence G. Shekell, both of Morgan, Pa.

[73] Assignee: Power & Industrial Services Corp., Morgan, Pa.

[21] Appl. No.: 674,865

[22] Filed: Mar. 11, 1991

[51] Int. Cl.[5] ..... B23P 15/26

[52] U.S. Cl. ..... 29/890.043; 29/463; 29/464

[58] Field of Search ..... 29/463, 464, 749, 890.043; 248/671, 672, 673, 62

[56] References Cited

U.S. PATENT DOCUMENTS 2,347,411 4/1944 Hafer et al. ..... 29/464

4,846,391 7/1989 McClure ..... 29/464

4,964,207 10/1990 Daniel ..... 29/464 X 5,011,398 4/1991 van Rens ..... 29/464 X

*Primary Examiner*—Irene Cuda

*Attorney, Agent, or Firm*—Carothers & Carothers

[57] ABSTRACT

A self aligning tube alignment bar for aligning and retaining a vertical series of boiler tubes in parallel. The tube alignment bar is comprised of two elongated parallel bar halves having a series of opposed recesses with interengaging protrusions therebetween to initially loosely confine the series of tubes respectively in a separated series. Thereafter the two halves are drawn together by bolts causing the two alignment bar halves to have their protrusions interengage and thereby guide the two halves together in clamping engagement such that ultimately the tubes are retained in a parallel series.

2 Claims, 2 Drawing Sheets

METHOD AND APPARATUS FOR ALIGNING AND CLAMPING A SERIES OF TUBES IN PARALLEL

BACKGROUND OF THE INVENTION

The present invention relates to the field of retaining clamps and more particularly to what is referred in the industry as tube alignment bars which are utilized to clamp a series of tubes in parallel with each other.

Steam boilers used for heating utilize a series of boiler tubes which are generally exposed and vertically hang downward from the ceiling of a building structure and swing free in this position. These tubes are referred to in the industry as secondary super heater or reheat tubes, or heat recovery tubes for recovering lost heat. These boiler tubes must be aligned and held in position in parallel.

The presently known procedure for clamping these boiler tubes together in parallel incorporates a tube alignment bar which consists of two elongated parallel bar halves for clamping a series of these tubes in parallel therebetween such that the tubes are then running perpendicular to the bar halves. These bar halves each have a series of recesses which oppose each other when the two bar halves are aligned in parallel to thereby in combination provide a series of split ring openings when the bar halves are clamped together to receive the tubes in parallel alignment.

Alignment protrusions extend from each of bar half toward the other between each recess. Opposing alignment openings are provided between each recess on the other bar half to receive the respective alignment protrusions therethrough so that when the bars are clamped together in parallel engagement the protrusions extending from each bar half are guided through the opposed alignment openings in the other bar half so that when the clamping bars are fully engaged they form a series of rings for aligning and retaining the tubes therein in a parallel series.

The problem with these preexisting tube alignment bars is that the boiler tubes to be aligned and clamped in parallel are found in a relatively haphazzard nonaligned array. Accordingly, to even initially fit the tube alignment bars over a section of the series of boiler tubers one first has to provide an independent clamp which is screwed or otherwise clamped down on opposite sides of the tubes to be aligned to clamp the boiler tubes. The tubes are then adjusted in this clamp until they are properly spaced in parallel alignment with each other and the clamp is further secured to hold them in position. Only then can one initially apply the prior art alignment bar.

The tube alignment bar is provided or laid over the parallel prealigned tubes adjacent the clamp, clamped together, and the parallel bar halves thereof are then welded together to retain the tubes in their parallel alignment. Thereafter the initial alignment clamp and the clamp on the bar halves can then be removed and the process is again repeated.

The requirement of having to utilize these separate clamping arrangements greatly increases the labor time expended in finally attaching the tube alignment bars to rigidly support the boiler tubes in a parallel series.

In addition this prior art procedure also permits one to only align three to five of the adjacent tubes normally at one time and accordingly the tube alignment bars are typically manufactured to only clamp three to five tubes at one time in parallel alignment. Thereafter one then must clamp the adjacent three to five tubes in parallel alignment and then apply a second tube alignment bar set and the procedure is carried on until the entire series of boiler tubes is securely clamped in parallel alignment and held in position. Accordingly it can be seen that this procedure for prealigning and preclamping the tubes in addition to applying the tube alignment bars with further clamping means becomes very time consuming.

SUMMARY OF THE INVENTION

It is a principal object of the present invention to eliminate the necessity of providing a separate prealignment clamp to require a prealignment procedure prior to application of the tube alignment bars. The method and apparatus of the present invention provide a means for prealigning and clamping a series of tubes in parallel without the necessity of any prealigning equipment. The prealigning and final clamping capabilities are built right into the tube alignment bar itself.

The basic structure of the tube alignment bar of the present invention is similar to that of the alignment bar structure of the prior art in that the two elongated parallel bar halves for clamping tubes in parallel have a series of alignment protrusions which extend from one of the bars to the other and these protrusions are received in opposing openings in the opposing bar half for guiding the two parallel bar halves for proper engagement as they are being drawn together for clamping.

However, the improvement resides in an arrangement whereby selected of these protrusions extending from one or both of these bar halves toward the other, between the psuedoparallel series of tubes to be aligned, is replaced instead with elongated bolts or a similar appropriate bolt means which can be utilized to first loosely hold the two bars in spaced relationship from each other and thereafter be manipulated to draw the two bars together in clamping engagement with the tubes clamped in alignment therebetween. With this arrangement, the additional requirement of preclamping the bars in parallel prior to applying the tube alignment bars is completely eliminated. Also the two bar halves are provided with their own means to draw and clamp them together.

With the tube alignment bar arrangement and method of the present invention, the two elongated opposing bar halves which make up the tube alignment bar may be spaced relatively far apart on opposite sides of the tubes to be aligned and then, one by one, the bolts may be inserted so that the parallel but separated alignment bar halves are loosely held together so that the tubes can be progressively and easily inserted or positioned successively and respectively between the intermediate alignment protrusions and/or bolts. As the tubes are progressively positioned, but still misaligned, between the alignment bar halves the bolts may be progressively inserted.

After all bolts have been engaged to loosely contain the tubes between the alignment bar halves in psuedoparallel arrangement, the bolts may then be manipulated or turned down to bring the two halves of the tube alignment bar together in a guided fashion such that the protrusions from each tube alignment bar half protrude through the opposed openings in the other alignment bar half to properly guide the two halves together in clamping engagement with the tubes retained in parallel alignment thereby providing a self aligning feature for the tube alignment bar.

Once the alignment bar halves have been bolted together in this clamping arrangment, the bolt ends may then be cut off and the two tube alignment bar halves welded together at the areas where the alignment protrusions protrude through the openings of the opposite bar half.

Due to this self aligning feature of the tube alignment bar of the present invention, many more tubes can be prealigned and clamped at one time than was heretofore possible with the prior art apparatus and methods.

The alignment protrusions on the tube alignment bar halves may also be tapered so that they are thickest at their base where they join their respective alignment bar half thereby permitting their thinner points to more readily protrude into the opposed openings in the other alignment bar half for insured and proper guided engagement of the bars together.

In addition, both halves of the tube alignment bar may be identically formed so that one of them may be turned end for end to provide a matching clamping pair, thereby reducing manufacturing costs.

BRIEF DESCRIPTION OF THE DRAWINGS

Other objects and advantages appear in the following description and claims.

The accompanying drawings show, for the purpose of exemplification, without limiting the invention or the claims thereto, certain practical embodiments illustrating the principals of this invention wherein:

DETAILED DESCRIPTION OF A PREFERRED EMBODIMENT

Figure 5:
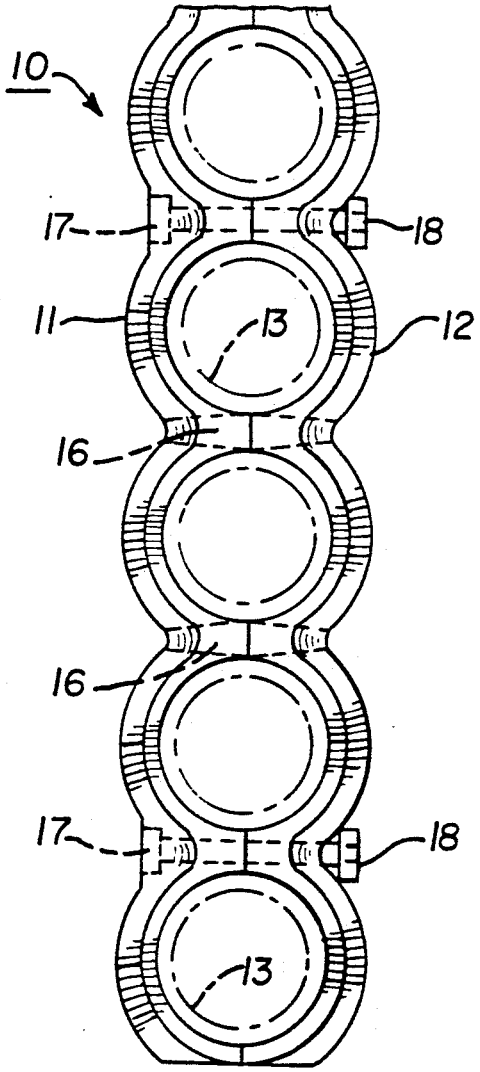
FIG. 5 is a view in side elevation of the self aligning tube alignment bar shown in FIGS. 1 through 4 with the two halves of the tube alignment bar clamped together with the tubes retained therebetween in a vertical parallel aligned series.

Referring to FIGS. 1, 2, 3 and 4, the self aligning tube alignment bar 10 of the present invention is comprised of two elongated parallel bars or bar halves 11 and 12 for clamping a series of tubes 13 therebetween in a vertical parallel alignment such that when the two halves 11 and 12 are drawn together as shown in FIG. 5, the alignment bar 10 appears to consist of two split ring alignment bar halves conforming to the exterior surfaces of the tubes aligned therebetween.

The alignment bar halves 11 and 12 are provided with a series of opposed concave seats or recesses 14 and tapered alignment protrusions 15 extend from each of the bar halves 11 and 12 toward the other bar. Opposing each tapered protrusion 15 in the other bar is provided a respective alignment opening 16, which are also tapered and aligned to receive and guide the respective tapered protrusion 15 extending from the other bar half.

Selected sets of these protrusions 15 and their respective guide openings 16 are replaced with bolts 17, which also assist in separating the respective tubes in their series. Bolts 17 serve to initially and loosely hold the two bar halves 11 and 12 together in a spaced relationship so that the bolts 17 may be progressively inserted and their nuts 18 attached to the opposite ends thereof to loosely hold the two bar halves together in a more or less parallel alignment. Accordingly the bolts may be progressively inserted as the tubes 13 (which are initially in a haphazzard psuedoparallel nonalignment) are respectively initially and progressively inserted between the protrusions of the alignment bar halves, or between protrusions 15 and one of the shafts of bolts 17 as illustrated best in FIG. 2.

Figure 1:
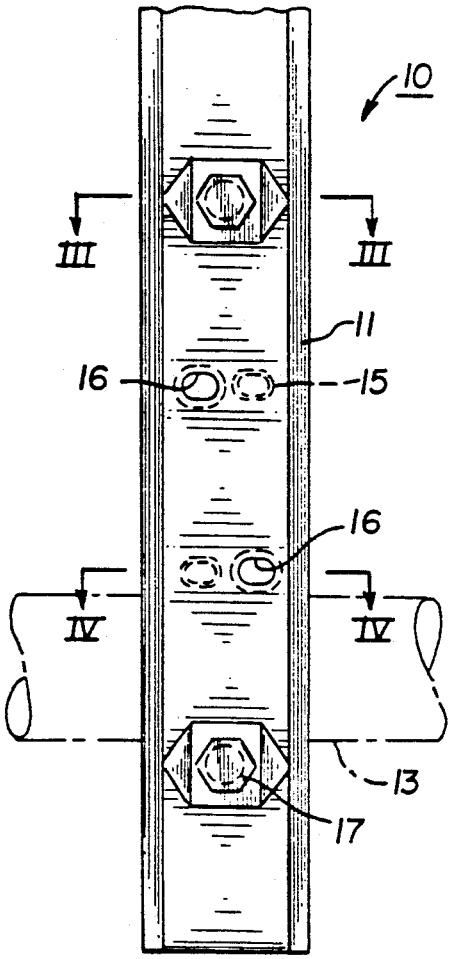
FIG. 1 is a view in front elevation illustrating one embodiment of the self aligning tube alignment bar of the present invention.
Figure 2:
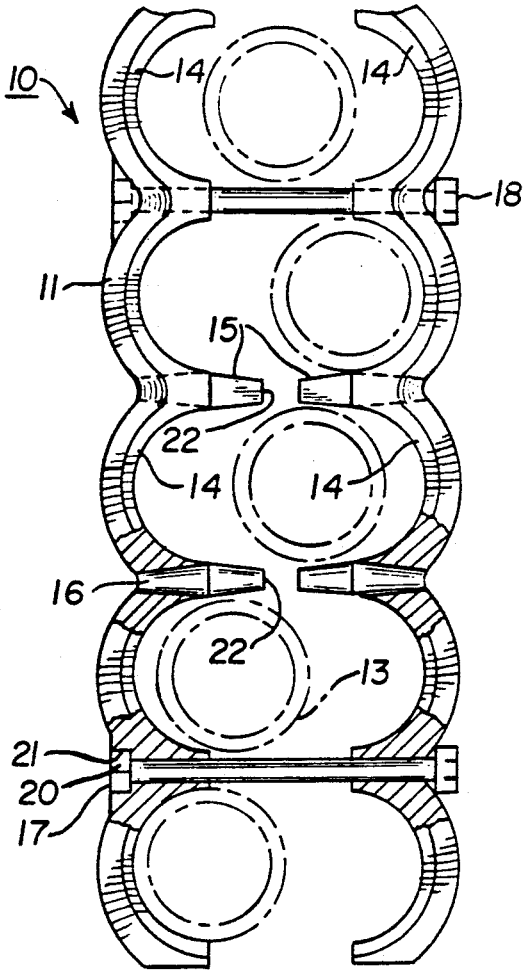
FIG. 2 is a view in side elevation of the self aligning tube alignment bar shown in FIG. 1 with portions thereof removed to reveal detail.
Figure 3:
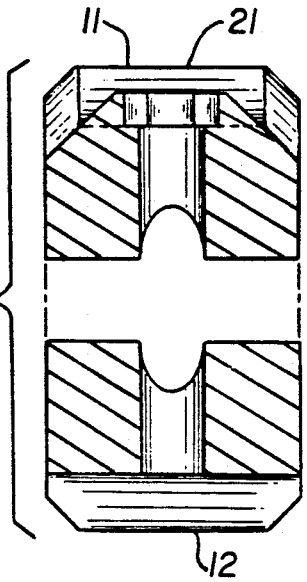
FIG. 3 is a sectional view of the self aligning tube alignment bar of FIG. 1 as seen along Section Line III—III with the bolts and tube outlines removed to provide an unobstructed disclosure.
Figure 4:
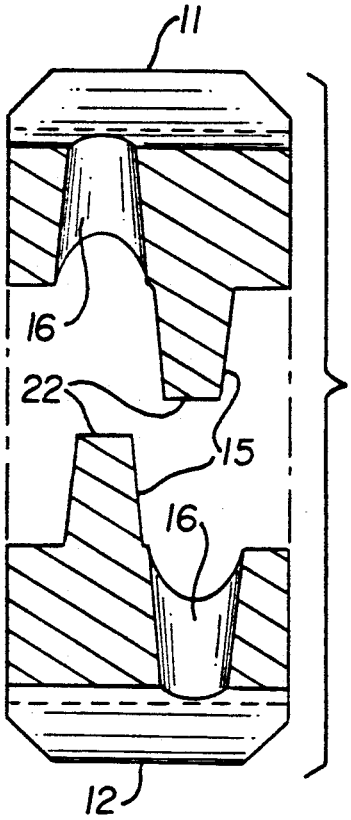
FIG. 4 is a sectional view of the self aligning tube alignment bar shown in FIG. 1 as seen along Section Line V—V with the bolts and tube outlines removed to provide an unobstructed disclosure.

Accordingly without the need or use of a preliminary clamp to clamp tubes 13 first in parallel evenly spaced alignment, one needs to merely roughly insert the tubes respectively in a vertical series between the two alignment bar halves 11 and 12 as illustrated in FIG. 2 and in so doing progressively insert bolts 17 and loosely attach nuts 18 so that the initial arrangement is as illustrated in FIG. 2.

Thereafter, nuts 18 may be drawn up and as they are progressively drawn up the heads 20 of bolt 17 are rigidly held from turning in conforming recesses 21 in alignment bar half 11. As the drawing up of nuts 18 progresses the tapered guide or alignment protrusions 15 will gradually enter and self guide themselves into their respective opposing guide openings 16. Therefore, as the two alignment bar halves 11 and 12 are thus drawn together they automatically self align the tubes 13 into a vertical parallel series as indicated in FIG. 5.

As is also indicated in FIG. 5, the ends of bolts 17 which extend beyond the secured nuts 18 are cut off. Additionally, the forward ends 22 of protrusions 15 may also be welded to the periphery of openings 16 in the opposing alignment bar halves to further secure the two alignment bar halves 11 and 12 together in secure clamping engagement. With the method and apparatus of the present invention, the self aligning tube alignment bar 10 is provided with its own means for clamping the bar halves 11 and 12 together in the form of bolts 17.

I claim:

1. A method for prealigning and clamping a series of tubes in parallel alignment comprising the steps of: providing two elongated parallel bar halves, having a series of spaced alignment protrusions extending from at least one of said bar halves toward the other of said bar halves and having opposing alignment openings through the other of said bar halves for respectively receiving said protrusions therethrough in alignment when said bar halves are clamped toward each other, positioning said bar halves in parallel with each other with a series of nonaligned psuedoparallel tubes respectively positioned in prealignment between said protrusions and perpendicular to said bar halves, and thereafter drawing said bar halves together in guided clamping engagement to retain said tubes in parallel alignment.

2. The method of claim 1 including the step of welding said bar halves together after they are clamped together.

* * * * *